US010276912B2

(12) United States Patent
Goto

(10) Patent No.: US 10,276,912 B2
(45) Date of Patent: Apr. 30, 2019

(54) DIRECTIONAL COUPLER

(71) Applicant: TDK Corporation, Tokyo (JP)

(72) Inventor: Tetsuzo Goto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 52 days.

(21) Appl. No.: 15/787,059

(22) Filed: Oct. 18, 2017

(65) Prior Publication Data

US 2018/0123214 A1 May 3, 2018

(30) Foreign Application Priority Data

Oct. 31, 2016 (JP) ..... 2016-213467

(51) Int. Cl.
*H01P 5/18* (2006.01)

(52) U.S. Cl.
CPC ..... *H01P 5/184* (2013.01); *H01P 5/187* (2013.01)

(58) Field of Classification Search
CPC ..... H01P 5/18; H01P 5/184
USPC ..... 333/109
See application file for complete search history.

(56) References Cited

U.S. PATENT DOCUMENTS

| | | | | |
|---|---|---|---|---|
| 6,208,220 | B1 * | 3/2001 | Logothetis | H01P 5/185 333/116 |
| 9,653,771 | B2 * | 5/2017 | Ootsuka | H01P 5/184 |
| 9,893,407 | B2 * | 2/2018 | Ootsuka | H01P 5/18 |
| 9,893,408 | B2 * | 2/2018 | Ashida | H01P 5/18 |
| 10,084,225 | B2 * | 9/2018 | Ashida | H01P 5/18 |
| 2012/0319797 | A1 | 12/2012 | Tamaru | |

FOREIGN PATENT DOCUMENTS

JP 2013-005076 A 1/2013

* cited by examiner

*Primary Examiner* — Dean O Takaoka
(74) *Attorney, Agent, or Firm* — Oliff PLC

(57) ABSTRACT

The auxiliary ground layer is a part in which the main line and the sub line do not overlap in the lamination direction and is disposed to face a part in which a distance from the first ground layer and a distance from the second ground layer are different in the lamination direction. When a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of a>c≥b is satisfied.

5 Claims, 14 Drawing Sheets

DIRECTIONAL COUPLER

TECHNICAL FIELD

The present invention relates to a directional coupler.

BACKGROUND

In the related art, a directional coupler described in, for example, Patent Literature 1 (Japanese Unexamined Patent Publication No. 2013-5076), is known. The directional coupler described in Patent Literature 1 includes a first terminal to a fourth terminal, a main line connected between the first terminal and the second terminal, a first sub line that is connected to the third terminal and is electromagnetically coupled to the main line, a second sub line that is connected to the fourth terminal and is electromagnetically coupled to the main line, and a phase converter that is connected between the first sub line and the second sub line and generates a phase shift in a passing signal. In the directional coupler, the main line, the first sub line, and the second sub line are disposed between a pair of ground layers that are connected to the ground.

SUMMARY

In the directional coupler of the related art, a main line and a sub line are disposed between a pair of ground layers. The main line and the sub line are disposed at different positions in a direction in which a pair of ground layers face each other. In such a configuration, a distance between the main line and one ground layer and a distance between the main line and the other ground layer are different. Similarly, a distance between the sub line and one ground layer and a distance between the sub line and the other ground layer are different. In this case, in a part in which the main line and the sub line do not overlap, a deviation of an impedance may occur in the main line and the sub line. As a result, there is a risk of deterioration of isolation characteristics.

An aspect of the present invention provides a directional coupler capable of improving isolation characteristics.

A directional coupler according to an aspect of the present invention includes an element body formed by laminating a plurality of insulator layers and an input terminal and an output terminal that are disposed on an outer surface of the element body. In the element body, a main line connected between the input terminal and the output terminal, a sub line of which at least a part overlaps the main line in a direction in which the plurality of insulator layers are laminated and which is electromagnetically coupled to the main line, a first ground layer and a second ground layer that are disposed at positions with the main line and the sub line therebetween in the lamination direction, and an auxiliary ground layer that is electrically connected to the first ground layer or the second ground layer, are provided. The auxiliary ground layer is a part in which the main line and the sub line do not overlap in the lamination direction and is disposed to face the non-overlapping part in which a distance from the first ground layer and a distance from the second ground layer are different in the lamination direction. When a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of $a>c\geq b$ is satisfied.

In the directional coupler according to the aspect of the present invention, the auxiliary ground layer is provided in the element body. The auxiliary ground layer is a part in which the main line and the sub line do not overlap in the lamination direction and is disposed to face the non-overlapping part in which a distance from the first ground layer and a distance from the second ground layer are different in the lamination direction. In the directional coupler, when a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of $a>c\geq b$ is satisfied. In such a configuration, due to the auxiliary ground layer, a difference in the distance between the third distance c in the part in which the main line and the sub line do not overlap and the second distance b can be reduced. Thus, in the directional coupler, it is possible for occurrence of deviation in the impedance to be suppressed in the part in which the main line and the sub line do not overlap. Thus, in the directional coupler, it is possible to improve isolation characteristics.

In the embodiment, the auxiliary ground layer may be provided at a position (b=c) at which the second distance b and the third distance c are the same. Therefore, in the directional coupler, it is possible for occurrence of deviation in the impedance to be further suppressed in the part in which the main line and the sub line do not overlap. Thus, in the directional coupler, it is possible to improve isolation characteristics.

In the embodiment, a plurality of auxiliary ground layers may be provided in the lamination direction. In such a configuration, it is possible to easily adjust positions of the auxiliary ground layers. Thus, it is possible to easily adjust a distance between the part in which the main line and the sub line do not overlap and the auxiliary ground layer.

In the embodiment, the auxiliary ground layer may be electrically connected to the first ground layer or the second ground layer by a through-hole conductor. In such a configuration, it is possible to reliably electrically connect the auxiliary ground layer to the first ground layer or the second ground layer.

In the embodiment, the sub line may be formed by a first sub line and a second sub line that are electrically connected to each other, and the first sub line and the second sub line may be disposed at positions with the main line therebetween in the lamination direction. In such a configuration, it is possible to increase a coupling value with respect to the main line. In addition, in such a configuration, since positions at which the first sub line and the second sub line are disposed are different, a distance from the first ground layer and a distance from the second ground layer are significantly different in the first sub line and the second sub line. Therefore, a configuration in which the auxiliary ground layer is provided is particularly effective.

According to the aspect of the present invention, it is possible to improve isolation characteristics.

DETAILED DESCRIPTION

Figure 1:
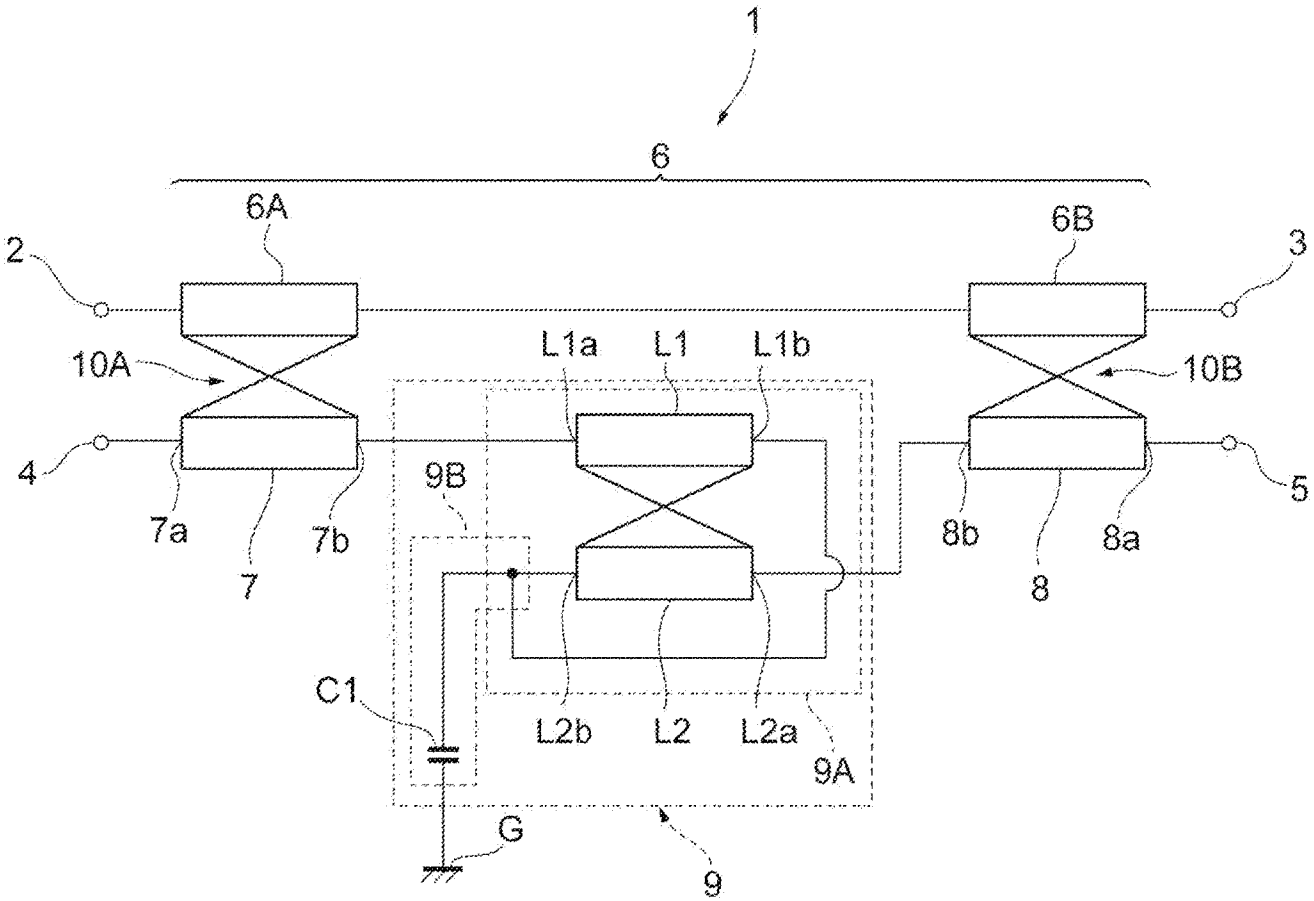
FIG. 1 is a diagram showing an equivalent circuit of a laminated coupler according to a first embodiment.

Exemplary embodiments of the present invention will be described below with reference to the accompanying drawings. Here, in descriptions of drawings, the same or corresponding components are denoted by the same reference numerals and redundant descriptions will be omitted.

First Embodiment

As shown in FIG. 1, a laminated coupler (directional coupler) 1 includes an input port (input terminal) 2, an output port (output terminal) 3, a coupling port 4, and a termination port 5. The laminated coupler 1 includes a main line 6 that is connected between the input port 2 and the output port 3, a first sub line 7 and a second sub line 8 that are electromagnetically coupled to the main line 6, and a phase adjustment circuit 9 that is connected between the first sub line 7 and the second sub line 8.

The main line 6 includes a first part 6A that is electromagnetically coupled to the first sub line 7 and a second part 6B that is electromagnetically coupled to the second sub line 8. A part in which the first part 6A and the first sub line 7 are coupled to each other is defined as a first coupling part 10A. A part in which the second part 6B and the second sub line 8 are coupled to each other is defined as a second coupling part 10B. The first sub line 7 includes a first end 7*a* and a second end 7*b*. The first end 7*a* is electrically connected to the coupling port 4. The second sub line 8 includes a first end 8*a* and a second end 8*b*. The first end 8*a* is electrically connected to the termination port 5.

The phase adjustment circuit 9 includes a first path 9A that electrically connects the first sub line 7 and the second sub line 8 and a second path 9B that connects the first path 9A and a ground G. The first path 9A includes a first inductor L1 and a second inductor L2. The second path 9B includes a capacitor C1.

The first inductor L1 includes a first end L1*a* and a second end L1*b*. The second inductor L2 includes a first end L2*a* and a second end L2*b*. The first end L1*a* of the first inductor L1 is electrically connected to the second end 7*b* of the first sub line 7. The second end L1*b* of the first inductor L1 is electrically connected to the second end L2*b* of the second inductor L2. The first end L2*a* of the second inductor L2 is electrically connected to the second end 8*b* of the second sub line 8.

In the laminated coupler 1, a high frequency signal is input from the input port 2, and the high frequency signal is output from the output port 3. From the coupling port 4, a coupling signal having a power corresponding to a high frequency signal input to the input port 2 is output.

Between the input port 2 and the coupling port 4, a first signal path that passes through the first coupling part 10A, and a second signal path that passes through the second coupling part 10B and the phase adjustment circuit 9 are formed. When a high frequency signal is input to the input port 2, the coupling signal output from the coupling port 4 is a signal obtained by combining a signal that has passed through the first signal path and a signal that has passed through the second signal path. A phase difference occurs between the signal that has passed through the first signal path and the signal that has passed through the second signal path. A degree of coupling of the laminated coupler 1 depends on a degree of coupling of each of the first coupling part 10A and the second coupling part 10B and a phase difference between the signal that has passed through the first signal path and the signal that has passed through the second signal path.

Between the output port 3 and the coupling port 4, a third signal path that passes through the first coupling part 10A and a fourth signal path that passes through the second coupling part 10B and the phase adjustment circuit 9 are formed. Isolation of the laminated coupler 1 depends on a degree of coupling of each of the first coupling part 10A and the second coupling part 10B and a phase difference between the signal that has passed through the third signal path and the signal that has passed through the fourth signal path. The first coupling part 10A, the second coupling part 10B, and the phase adjustment circuit 9 have a function of preventing a change in the degree of coupling of the laminated coupler 1 according to a change in the frequency of the high frequency signal.

Figure 2:
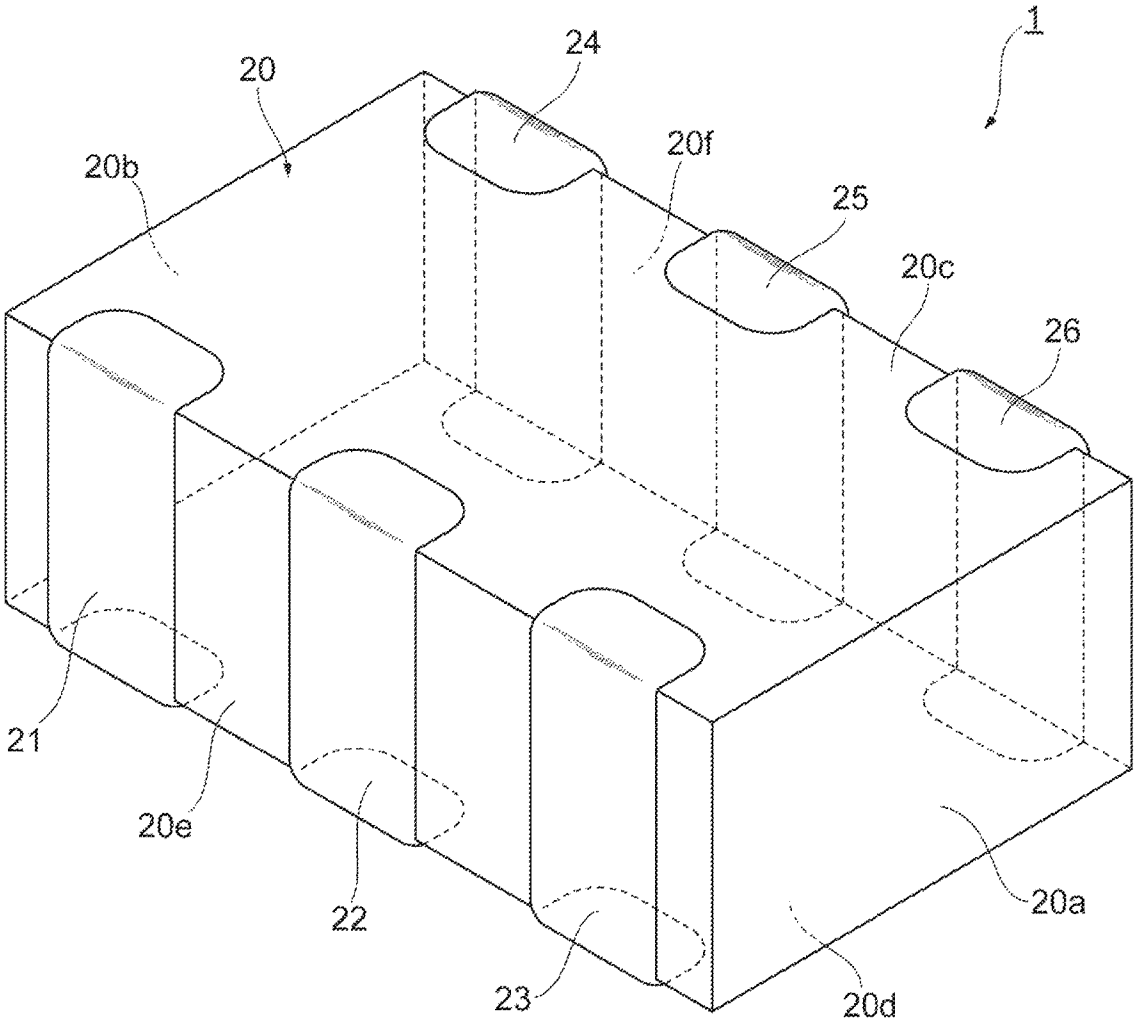
FIG. 2 is a perspective view showing a laminated coupler.

Next, a structure of the laminated coupler 1 will be described. As shown in FIG. 2, the laminated coupler 1 includes an element body 20, a first terminal electrode 21, a second terminal electrode 22, a third terminal electrode 23, a fourth terminal electrode 24, a fifth terminal electrode 25, and a sixth terminal electrode 26.

The element body 20 has a rectangular parallelepiped shape. The element body 20 includes a pair of end surfaces 20*a* and 20*b* that face each other as outer surfaces, a pair of main surfaces 20*c* and 20*d* that extend to link the pair of end surfaces 20*a* and 20*b* and face each other, and a pair of side surfaces 20*e* and 20*f* that extend to link the pair of main surfaces 20*c* and 20*d* and face each other. The main surface 20*d* is defined as a surface that faces another electronic device, for example, when the laminated coupler 1 is mounted in the electronic device (for example, a circuit board or an electronic component) (not shown).

A direction in which the end surfaces 20*a* and 20*b* face each other, a direction in which the main surfaces 20*c* and 20*d* face each other, and a direction in which the side surfaces 20*e* and 20*f* face each other are substantially orthogonal to each other. Here, the rectangular parallelepiped shape includes a rectangular parallelepiped shape in which corner parts and ridge parts are chamfered and a rectangular parallelepiped shape in which corner parts and ridge parts are rounded.

Figure 3:
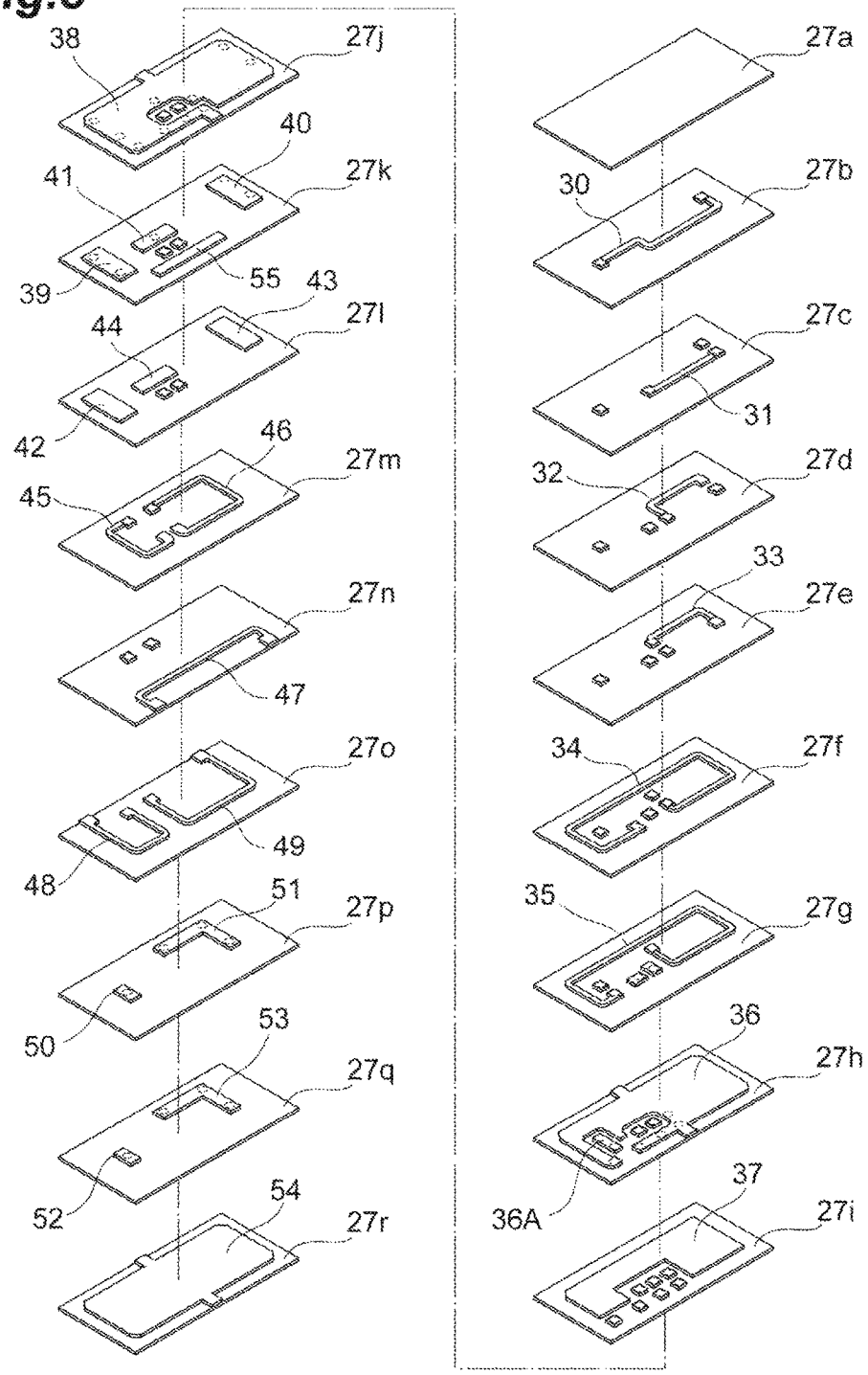
FIG. 3 is an exploded perspective view of an element body.

The element body 20 is formed by laminating a plurality of insulator layers 27 (27*a* to 27*r*) (refer to FIG. 3). The insulator layers 27 are laminated in the facing direction of the main surfaces 20*c* and 20*d* of the element body 20. That is, the lamination direction of the insulator layers 27 matches the facing direction of the main surfaces 20*c* and 20*d* of the element body 20. The facing direction of the main surfaces 20*c* and 20*d* will be referred to as a "lamination direction" below. The insulator layers 27 have a substantially rectangular shape. The insulator layer 27*a* is the uppermost layer of the element body 20 and constitutes the main surface 20*c*. The insulator layer 27*r* is the lowermost layer of the element body 20 and constitutes the main surface 20*d*. In the actual element body 20, the insulator layers 27 are integrated to an extent at which it is not possible to visually recognize a boundary between the layers.

The insulator layers 27 include a ceramic green sheet sintered material containing, for example, a dielectric material (such as a $BaTiO_3$-based material, a $Ba(Ti, Zr)O_3$-based material, a $(Ba, Ca)TiO_3$-based material, a glass material, or an alumina material). In the actual element body 20, the insulator layers 27 are integrated to an extent at which it is not possible to visually recognize a boundary between the layers.

The first terminal electrode 21, the second terminal electrode 22, and the third terminal electrode 23 are disposed on the side of the side surface 20*e* of the element body 20. The first terminal electrode 21, the second terminal electrode 22, and the third terminal electrode 23 are formed to cover a part of the side surface 20*e* in the lamination direction of the element body 20 and are formed in a part of the main surface 20*c* and a part of the main surface 20*d*. The first terminal electrode 21 is positioned on the side of the end surface 20*b*, and the third terminal electrode 23 is positioned on the side of the end surface 20*a*. The second terminal electrode 22 is positioned between the first terminal electrode 21 and the third terminal electrode 23.

The fourth terminal electrode 24, the fifth terminal electrode 25, and the sixth terminal electrode 26 are disposed on the side of the side surface 20*f* of the element body 20. The fourth terminal electrode 24, the fifth terminal electrode 25, and the sixth terminal electrode 26 are formed to cover a part of the side surface 20*f* in the lamination direction of the element body 20 and are formed in a part of the main surface 20*c* and a part of the main surface 20*d*. The fourth terminal electrode 24 is positioned on the side of the end surface 20*b*, and the sixth terminal electrode 26 is positioned on the side of the end surface 20*a*. The fifth terminal electrode 25 is positioned between the fourth terminal electrode 24 and the sixth terminal electrode 26.

The terminal electrodes 21 to 26 contain a conductive material (for example, Ag or Pd). The terminal electrodes 21 to 26 include a conductive paste sintered material containing a conductive material (for example, Ag powder or Pd powder). A plating layer is formed on surfaces of the terminal electrodes 21 to 26. The plating layer is formed by, for example, electroplating. The plating layer has a layer structure that includes a Cu plating layer, an Ni plating layer, and an Sn plating layer or a layer structure that includes an Ni plating layer and an Sn plating layer.

In the present embodiment, the first terminal electrode 21 constitutes the input port 2. The second terminal electrode 22 constitutes the ground G. The third terminal electrode 23 constitutes the output port 3. The fourth terminal electrode 24 constitutes the coupling port 4. The fifth terminal electrode 25 constitutes the ground G The sixth terminal electrode 26 constitutes the termination port 5.

As shown in FIG. 3, a conductor layer 30, a conductor layer 31, a conductor layer 32, a conductor layer 33, a conductor layer 34, a conductor layer 35, a conductor layer 36, a conductor layer 36A, and a conductor layer 37 are formed on the insulator layers 27*b* to 27*i*. The conductor layer 36 and the conductor layer 36A are disposed on the same insulator layer 27*h*. The conductor layers 30 to 37 constitute the phase adjustment circuit 9. The conductor layers 30 to 37 are formed by including, for example, at least one of Ag and Pd, as a conductive material. The conductor layers 30 to 37 include a conductive paste sintered material containing at least one of Ag and Pd as a conductive material. In the following description, the conductor layers are formed in the same manner.

Figure 4:
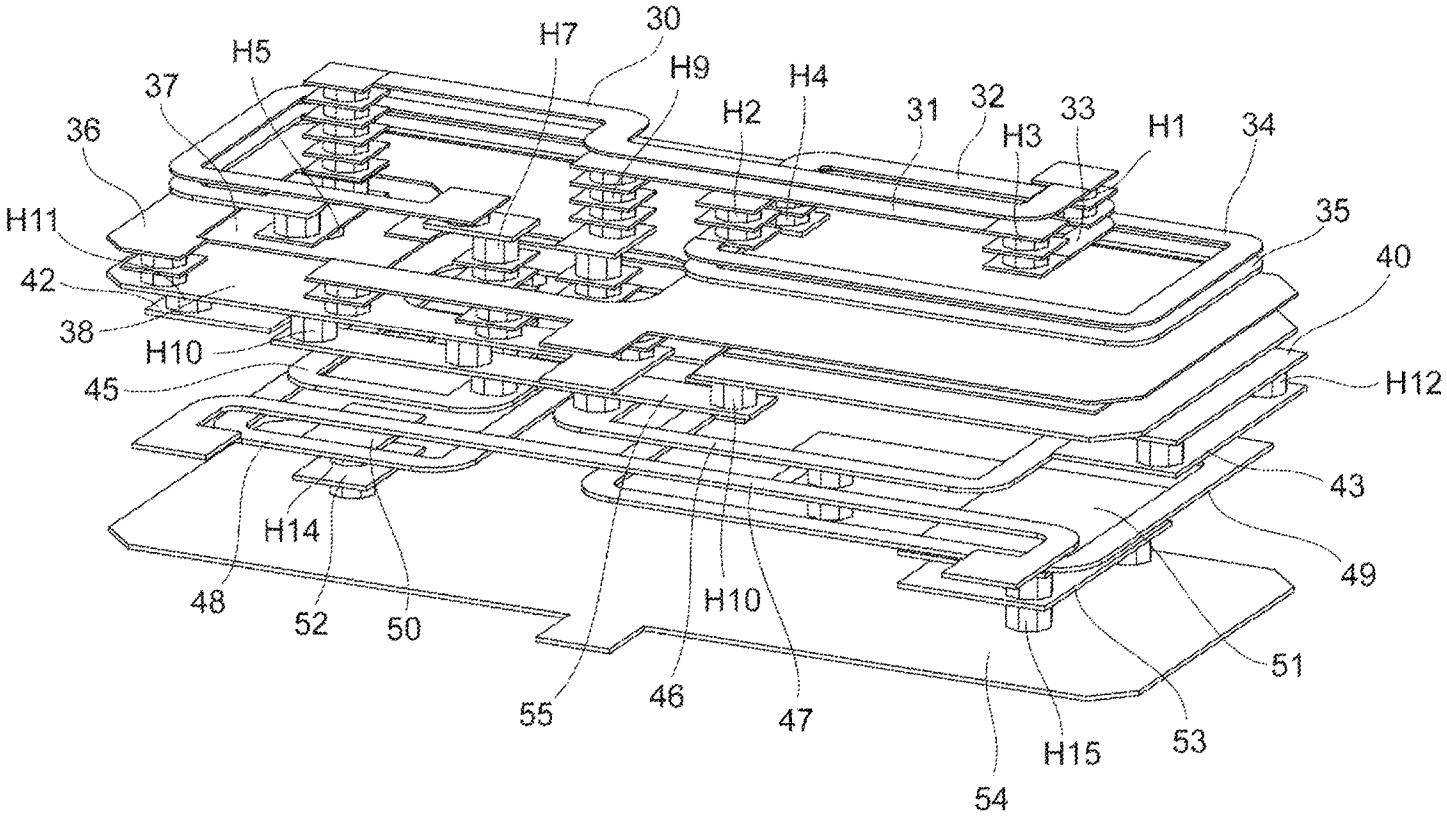
FIG. 4 is a perspective view showing a configuration in an element body.

The conductor layer 30, the conductor layer 32, and the conductor layer 34 constitute the first inductor L1. As shown in FIG. 4, the conductor layer 30, the conductor layer 32, and the conductor layer 34 are electrically connected by through-hole conductors H1 and H2. One end of the conductor layer 30 constitutes the first end L1*a* of the first inductor L1. One end of the conductor layer 34 constitutes the second end L1*b* of the first inductor L1.

The conductor layer 31, the conductor layer 33, and the conductor layer 35 constitute the second inductor L2. The conductor layer 31, the conductor layer 33, and the conductor layer 35 are electrically connected by through-hole conductors H3 and H4. One end of the conductor layer 35 constitutes the second end L2*b* of the second inductor L2. One end of the conductor layer 31 constitutes the first end L2*a* of the second inductor L2. The first inductor L1 and the second inductor L2 are electrically connected by the conductor layer 36A. The conductor layer 36A is electrically connected to the conductor layer 37 by a through-hole conductor H5. The conductor layer 36 is electrically connected to the second terminal electrode 22 and the fifth terminal electrode 25. The conductor layer 36 and the conductor layer 37 constitute the capacitor C1.

Figure 6:
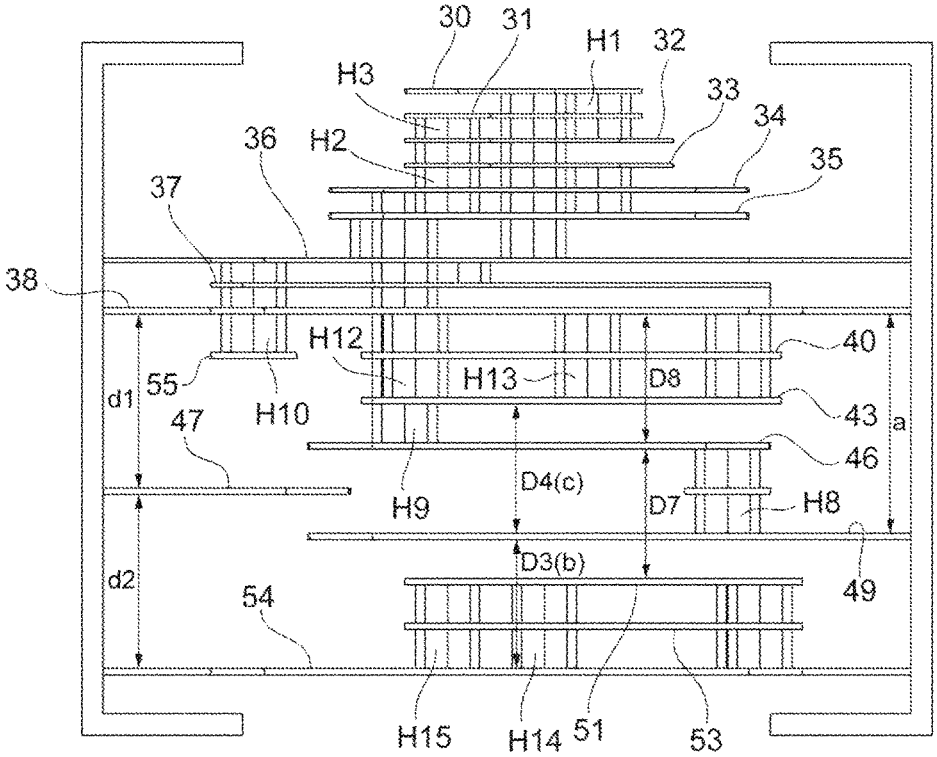
FIG. 6 is a diagram of a configuration in an element body viewed from the side of one end surface.
Figure 7:
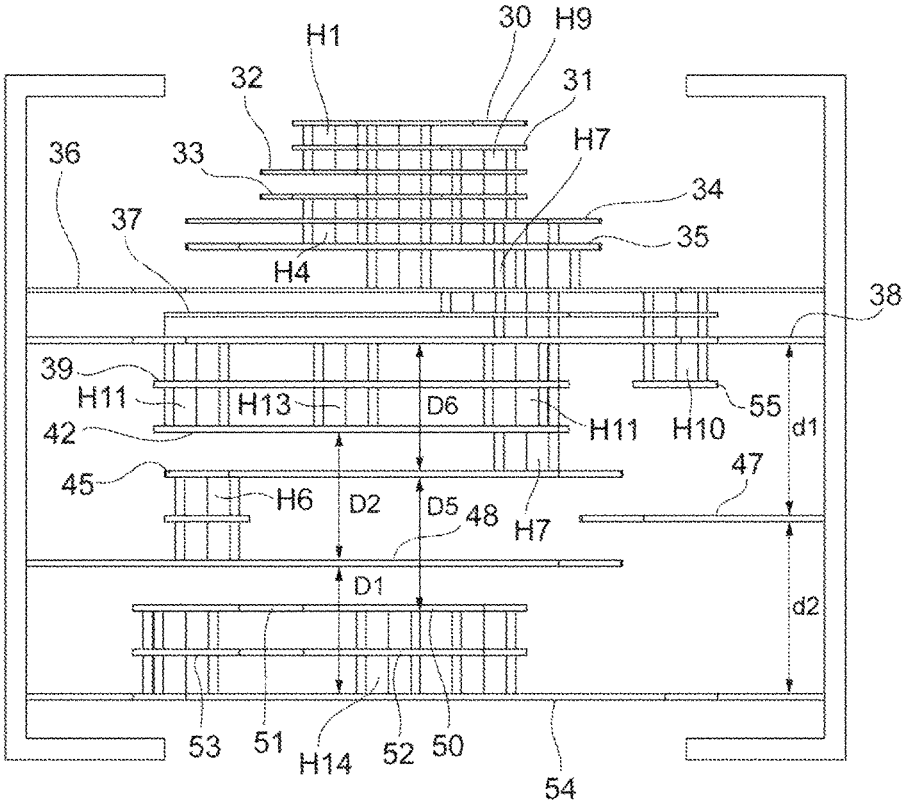
FIG. 7 is a diagram of a configuration in an element body viewed from the side of the other end surface.

As shown in FIG. 3, the conductor layer 47 is formed on the insulator layer 27*n*. A conductor layer 47 constitutes the main line 6. One end of the conductor layer 47 is electrically connected to the first terminal electrode 21 (the input port 2). The other end of the conductor layer 47 is electrically connected to the third terminal electrode 23 (the output port 3). As shown in FIG. 6 and FIG. 7, the conductor layer 47 is disposed at a position (d1=d2) in which a distance d1 between the conductor layer 47 and a conductor layer 38 and a distance d2 between the conductor layer 47 and a conductor layer 54 are the same. That is, the conductor layer 47 is disposed at the center part between the conductor layer 38 and a conductor layer 53 in the lamination direction.

As shown in FIG. 3, a conductor layer 45 and a conductor layer 46 are formed on the insulator layer 27*m*. A conductor layer 48 and a conductor layer 49 are formed on the insulator layer 27*o*. The conductor layer 45 and the conductor layer 48 constitute the first sub line 7. As shown in FIG. 7, the conductor layer 45 and the conductor layer 48 are electrically connected by a through-hole conductor H6. As shown in FIG. 4, one end of the conductor layer 45 is electrically connected to the conductor layer 34 by a through-hole conductor H7. One end of the conductor layer 45 constitutes the second end 7*b* of the first sub line 7. One end of the conductor layer 48 is electrically connected to the fourth terminal electrode 24 (the coupling port 4). One end of the conductor layer 48 constitutes the first end 7*a* of the first sub line 7.

The conductor layer 46 and the conductor layer 49 constitute the second sub line 8. The conductor layer 46 and the conductor layer 49 are electrically connected by a through-hole conductor H8. As shown in FIG. 6, one end of the conductor layer 46 is electrically connected to the conductor layer 31 by a through-hole conductor H9. One end of the conductor layer 46 constitutes the second end 8*b* of the second sub line 8. One end of the conductor layer 49 is electrically connected to the sixth terminal electrode 26. One end of the conductor layer 49 constitutes the first end 8*a* of the second sub line 8.

Figure 5:
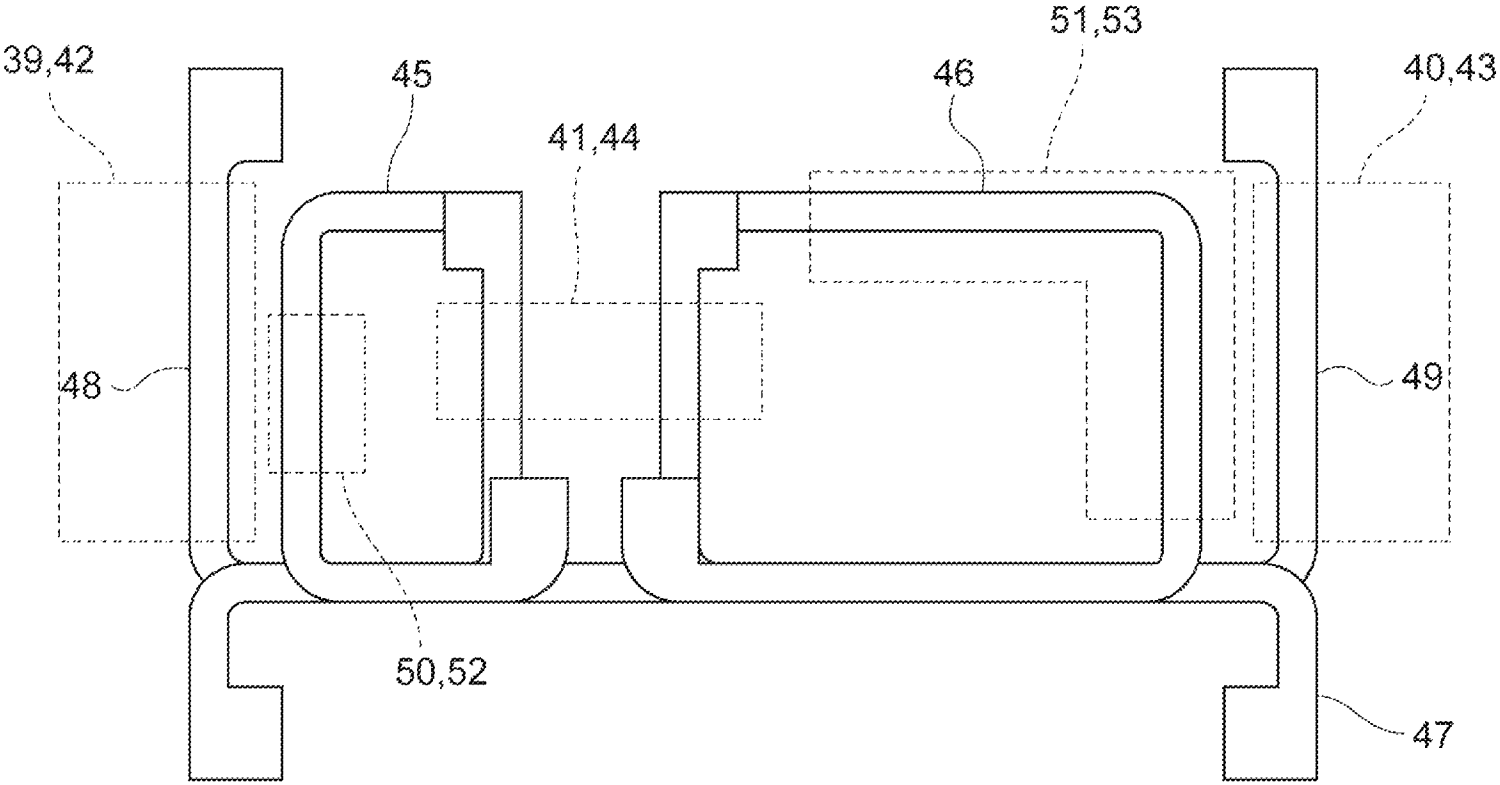
FIG. 5 is a diagram of a part of a conductor layer viewed in a lamination direction.

The conductor layer 45 and the conductor layer 48, and the conductor layer 46 and the conductor layer 49 are disposed at positions with the conductor layer 47 therebetween in the lamination direction. As shown in FIG. 5, the conductor layer 45 and the conductor layer 48 are disposed at positions at which parts thereof overlap the conductor layer 47 in the lamination direction. The conductor layer 46 and the conductor layer 49 are disposed at positions at which parts thereof overlap the conductor layer 47 in the lamination direction. A part in which the conductor layer 45 and the conductor layer 48 overlap the conductor layer 47 constitutes the first coupling part 10A. That is, a part of the conductor layer 47 that overlaps the conductor layer 45 and the conductor layer 48 constitutes the first part 6A. A part in which the conductor layer 46 and the conductor layer 49 overlap the conductor layer 47 constitutes the second coupling part 10B. That is, a part of the conductor layer 47 that overlaps the conductor layer 46 and the conductor layer 49 constitutes the second part 6B.

As shown in FIG. 7, a distance D6 between the conductor layer 45 and the conductor layer 38 is the same as the distance D1 between the conductor layer 48 and the conductor layer 54 (D6=D1). Accordingly, the conductor layer 45 and the conductor layer 38, and the conductor layer 48 and the conductor layer 54 are equivalent in a part (coupling part) in which the conductor layer 45 and the conductor layer 48 overlap the conductor layer 47 in the lamination direction. As shown in FIG. 6, a distance D8 between the conductor layer 46 and the conductor layer 38 and a distance D3 between the conductor layer 49 and the conductor layer 54 are the same (D8=D3). Accordingly, the conductor layer 46 and the conductor layer 38, and the conductor layer 49 and the conductor layer 54 are equivalent in a part in which the conductor layer 46 and the conductor layer 49 overlap the conductor layer 47 in the lamination direction.

As shown in FIG. 3, the conductor layer 38 is formed on the insulator layer 27*j*. The conductor layer 54 is formed on the insulator layer 27*r*. The conductor layer 45, the conductor layer 46, the conductor layer 47, the conductor layer 48, and the conductor layer 49 are disposed at positions with the conductor layer 38 and the conductor layer 54 therebetween in the lamination direction. That is, the main line 6, the first sub line 7, and the second sub line 8 are disposed at positions with the conductor layer 38 and the conductor layer 54 therebetween in the lamination direction. The conductor layer 38 and the conductor layer 54 are electrically connected to the second terminal electrode 22 (the ground G) and the fifth terminal electrode 25 (the ground G), respectively. The conductor layer 38 and the conductor layer 54 constitute ground layers (a first ground layer and a second ground layer).

A conductor layer 39, a conductor layer 40, and a conductor layer 41 are formed on the insulator layer 27*k*. In addition, a conductor layer 55 is formed on the insulator layer 27*k*. As shown in FIG. 4, the conductor layer 55 is electrically connected to the conductor layer 38 by a plurality of (here, four) through-hole conductors H10.

As shown in FIG. 3, a conductor layer 42, a conductor layer 43, and a conductor layer 44 are formed on the insulator layer 271. The conductor layer 39 and the conductor layer 42 are disposed at positions with the insulator layer 27*k* therebetween in the lamination direction. As shown in FIG. 4, the conductor layer 39 and the conductor layer 42 are electrically connected to the conductor layer 38 by a plurality of (here, two) through-hole conductors H11. That is, the conductor layer 39 and the conductor layer 42 are electrically connected to the ground G.

The conductor layer 40 and the conductor layer 43 are disposed at positions with the insulator layer 27*k* therebetween in the lamination direction. The conductor layer 40 and the conductor layer 43 are electrically connected to the conductor layer 38 by a plurality of (here, two) through-hole conductors H12. That is, the conductor layer 40 and the conductor layer 43 are electrically connected to the ground G. The conductor layer 41 and the conductor layer 44 are disposed at positions with the insulator layer 27*k* therebetween in the lamination direction. The conductor layer 41 and the conductor layer 44 are electrically connected to the conductor layer 38 by a through-hole conductor H13. That is, the conductor layer 41 and the conductor layer 44 are electrically connected to the ground G.

The conductor layer 39 and the conductor layer 42 are disposed at positions at which they overlap the conductor layer 48 in the lamination direction. Specifically, as shown in FIG. 5, the conductor layer 39 and the conductor layer 42 are disposed in a part in which the conductor layer 48 does not overlap the conductor layer 47 in the lamination direction and at a position at which overlapping occurs in the lamination direction. The conductor layer 42 faces the conductor layer 48 with the insulator layers 27*l* to 27*n* therebetween.

The conductor layer 40 and the conductor layer 43 are disposed at positions at which they overlap the conductor layer 49 in the lamination direction. Specifically, as shown in FIG. 5, the conductor layer 40 and the conductor layer 43 are disposed in a part in which the conductor layer 49 does not overlap the conductor layer 47 in the lamination direction and at a position at which overlapping occurs in the lamination direction. The conductor layer 43 faces the conductor layer 49 with the insulator layers 27*l* to 27*n* therebetween.

The conductor layer 41 and the conductor layer 44 are disposed at positions in which they overlap the conductor layer 48 and the conductor layer 49 in the lamination direction. Specifically, as shown in FIG. 5, the conductor layer 41 and the conductor layer 44 are disposed in a part in which the conductor layer 48 and the conductor layer 49 do not overlap the conductor layer 47 in the lamination direction and at a position at which overlapping occurs in the lamination direction. The conductor layer 44 faces the conductor layer 48 and the conductor layer 49 with the insulator layers 27*l* to 27*n* therebetween.

A conductor layer 50 and a conductor layer 51 are formed on the insulator layer 27*p*. A conductor layer 52 and the conductor layer 53 are formed on the insulator layer 27*q*. The conductor layer 50 and the conductor layer 52 are disposed at positions with the insulator layer 27*p* therebetween in the lamination direction. The conductor layer 50 and the conductor layer 52 are electrically connected to the conductor layer 54 by a through-hole conductor H14. That is, the conductor layer 50 and the conductor layer 52 are electrically connected to the ground G.

The conductor layer 51 and the conductor layer 53 are disposed at positions with the insulator layer 27*p* therebetween in the lamination direction. The conductor layer 51 and the conductor layer 53 are electrically connected to the conductor layer 54 by a plurality of (here, three) through-hole conductors H15. That is, the conductor layer 51 and the conductor layer 53 are electrically connected to the ground G.

The conductor layer 50 and the conductor layer 52 are disposed at positions at which they overlap the conductor layer 45 in the lamination direction. Specifically, as shown in FIG. 5, the conductor layer 50 and the conductor layer 52 are disposed at a part in which the conductor layer 45 does not overlap the conductor layer 47 in the lamination direction and at a position at which overlapping occurs in the lamination direction. The conductor layer 50 faces the conductor layer 45 with the insulator layers 27*m* to 27*o* therebetween.

The conductor layer 51 and the conductor layer 53 are disposed at positions at which they overlap the conductor layer 46 in the lamination direction. Specifically, as shown in FIG. 5, the conductor layer 51 and the conductor layer 53 are disposed in a part in which the conductor layer 46 does not overlap the conductor layer 47 in the lamination direction and at a position at which overlapping occurs in the lamination direction. The conductor layer 51 faces the conductor layer 46 with the insulator layers 27*m* to 27*o* therebetween.

The conductor layer 39 and the conductor layer 42, the conductor layer 40 and the conductor layer 43, the conductor layer 41 and the conductor layer 44, the conductor layer 50 and the conductor layer 52, and the conductor layer 51 and the conductor layer 53 constitute auxiliary ground layers. The auxiliary ground layer is a part in which the main line 6 does not overlap the first sub line 7 and the second sub line 8 in the lamination direction and is disposed to face the non-overlapping part in which a distance from the first ground layer (the conductor layer 38) and a distance from the second ground layer (the conductor layer 54) are different in the lamination direction. In the laminated coupler 1, when a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of $a>c\geq b$ is satisfied. Specifically, for example, in an example shown in FIG. 6, a distance between the conductor layer 49 and the conductor layer 38 corresponds to the first distance a, a distance between the conductor layer 49 and the conductor layer 54 corresponds to the second distance b (D3), and a distance between the conductor layer 49 and the conductor layer 43 corresponds to the third distance c (D4). In the present embodiment, the auxiliary ground layer is provided at a position (c=b) at which the second distance b and the third distance c are the same.

In the present embodiment, as shown in FIG. 7, a distance (the first distance a) between a part of the conductor layer 48 that does not overlap the conductor layer 47 and the conductor layer 38 and a distance (the second distance b) between the non-overlapping part and the conductor layer 54 are different. Therefore, the conductor layer 39 and the conductor layer 42 are disposed in the part of the conductor layer 48 that does not overlap the conductor layer 47. Accordingly, the distance D1 (the second distance b) between a part in which the conductor layer 48 does not overlap the conductor layer 47 and the conductor layer 54 and the distance D2 (the third distance c) between a part in which the conductor layer 48 does not overlap the conductor layer 47 and the conductor layer 42 are the same (D1=D2). That is, the conductor layer 42 is disposed at a position separated from the conductor layer 38 toward the conductor layer 48 by a distance obtained by subtracting a distance between the non-overlapping part and the conductor layer 54 from a distance between the part of the conductor layer 48 that does not overlap the conductor layer 47 and the conductor layer 38.

In the present embodiment, as shown in FIG. 6, a distance (the first distance a) between a part of the conductor layer 49 that does not overlap the conductor layer 47 and the conductor layer 38 and a distance (the second distance b) between the non-overlapping part and the conductor layer 54 are different. Therefore, the conductor layer 40 and the conductor layer 43 are disposed in the part of the conductor layer 49 that does not overlap the conductor layer 47. Accordingly, a distance D3 (the second distance b) between the part of the conductor layer 49 that does not overlap the conductor layer 47 and the conductor layer 54 and a distance D4 (the third distance c) between the part of the conductor layer 49 that does not overlap the conductor layer 47 and the conductor layer 43 are the same (D3=D4). That is, the conductor layer 43 is disposed at a position separated from the conductor layer 38 toward the conductor layer 49 by a distance obtained by subtracting a distance between the non-overlapping part and the conductor layer 54 from a distance between the part of the conductor layer 49 that does not overlap the conductor layer 47 and the conductor layer 38.

In the present embodiment, a distance (the first distance a) between a part of the conductor layer 48 and the conductor layer 49 that does not overlap the conductor layer 47 and the conductor layer 38 and a distance (the second distance b) between the non-overlapping part and the conductor layer 54 are different. Therefore, the conductor layer 41 and the conductor layer 44 are disposed in the part of the conductor layer 48 and the conductor layer 49 that does not overlap the conductor layer 47. Thus, a distance (the second distance b) between a part of the conductor layer 48 and the conductor layer 49 that does not overlap the conductor layer 47 and the conductor layer 54 and a distance (the third distance c) between a part of the conductor layer 48 and the conductor layer 49 that does not overlap the conductor layer 47 and the conductor layer 44 are the same. That is, the conductor layer 44 is disposed at a position separated from the conductor layer 38 toward the conductor layer 48 and the conductor layer 49 by a distance obtained by subtracting a distance between the non-overlapping part and the conductor layer 54 from a distance between the part of the conductor layer 48 and the conductor layer 49 that does not overlap the conductor layer 47 and the conductor layer 38.

In the present embodiment, as shown in FIG. 7, a distance (the second distance b) between a part of the conductor layer 45 that does not overlap the conductor layer 47 and the conductor layer 38 and a distance (the first distance a) between the non-overlapping part and the conductor layer 54 are different. Therefore, the conductor layer 50 and the conductor layer 52 are disposed in the part of the conductor layer 45 that does not overlap the conductor layer 47. Thus, a distance D5 (the third distance c) between a part of the conductor layer 45 that does not overlap the conductor layer 47 and the conductor layer 50 and a distance D6 (the second distance b) between the part of the conductor layer 45 that does not overlap the conductor layer 47 and the conductor layer 38 are the same (D5=D6). That is, the conductor layer 50 is disposed at a position separated from the conductor layer 54 toward the conductor layer 45 by a distance obtained by subtracting a distance between the non-overlapping part and the conductor layer 38 from a distance between the part of the conductor layer 45 that does not overlap the conductor layer 47 and the conductor layer 54.

In the present embodiment, as shown in FIG. 6, a distance (the second distance b) between a part of the conductor layer 46 that does not overlap the conductor layer 47 and the conductor layer 38 and a distance (the first distance a) between the non-overlapping part and the conductor layer 54 are different. Therefore, the conductor layer 51 and the conductor layer 53 are disposed in a part of the conductor layer 46 that does not overlap the conductor layer 47. Therefore, a distance D7 (the third distance c) between a part in which the conductor layer 46 does not overlap the conductor layer 47 and the conductor layer 51 and a distance D8 (the second distance b) between a part in which the conductor layer 46 does not overlap the conductor layer 47 and the conductor layer 38 are the same (D7=D8). That is, the conductor layer 51 is disposed at a position separated from the conductor layer 54 toward the conductor layer 46 by a distance obtained by subtracting a distance between the non-overlapping part and the conductor layer 38 from a distance between the part of the conductor layer 46 that does not overlap the conductor layer 47 and the conductor layer 54.

As described above, the laminated coupler 1 according to the present embodiment, the auxiliary ground layer (the conductor layer 39 and the conductor layer 42, the conductor layer 40 and the conductor layer 43, the conductor layer 41 and the conductor layer 44, the conductor layer 50 and the conductor layer 52, and the conductor layer 51 and the conductor layer 53) are provided in the element body 20. The auxiliary ground layer is a part in which the main line 6 (the conductor layer 47) does not overlap the first sub line 7 (the conductor layer 45 and the conductor layer 48), and the second sub line 8 (the conductor layer 46 and the conductor layer 49) in the lamination direction and is disposed to face the non-overlapping part in which a distance from the first ground layer (the conductor layer 38) and a distance from the second ground layer (the conductor layer 54) are different in the lamination direction. In the laminated coupler 1, when a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of $a>c\geq b$ is satisfied. In such a configuration, due to the auxiliary ground layer, a difference in the distance between the third distance c in the part in which the main line and the sub line do not overlap and the second distance b can be reduced. Thus, in the laminated coupler 1, it is possible for occurrence of deviation in the impedance to be suppressed in the part in which the main line and the sub line do not overlap. Thus, in the laminated coupler 1, it is possible to improve isolation characteristics.

In the laminated coupler 1 according to the present embodiment, the auxiliary ground layer is provided at a position (b=c) at which the second distance b and the third distance c are the same. Therefore, in the laminated coupler 1, it is possible for occurrence of deviation in the impedance to be further suppressed in the part in which the main line and the sub line do not overlap. Thus, in the laminated coupler 1, it is possible to improve isolation characteristics.

Figure 8:
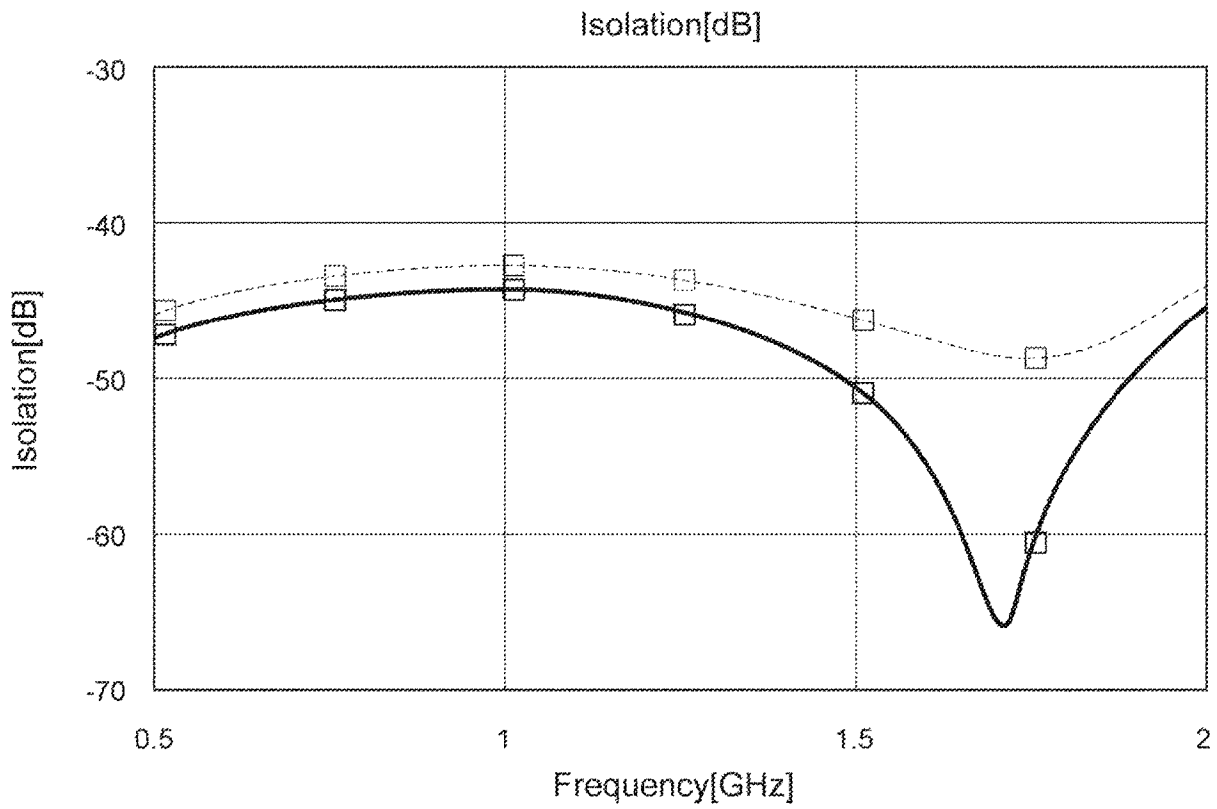
FIG. 8 is a diagram showing isolation characteristics.

In FIG. 8, a solid line represents isolation characteristics of the laminated coupler 1 according to the present embodiment. That is, it represents isolation characteristics in a configuration in which the auxiliary ground layer is provided. A dashed line represents isolation characteristics of a laminated coupler according to a comparative example. That is, it represents isolation characteristics in a configuration in which no auxiliary ground layer is provided. In FIG. 8, the horizontal axis represents frequency [GHz], and the vertical axis represents isolation [dB].

As shown in FIG. 8, in the laminated coupler 1 including the auxiliary ground layer, since it is possible for occurrence of deviation in an impedance to be suppressed, it is possible to reduce isolation at high frequencies compared to a laminated coupler of the related art. Thus, in the laminated coupler 1, it is possible to improve isolation characteristics.

In the laminated coupler 1 according to the present embodiment, the auxiliary ground layer includes a plurality of conductor layers. Specifically, in the present embodiment, the auxiliary ground layer includes two conductor layers (the conductor layer 39 and the conductor layer 42, the conductor layer 40 and the conductor layer 43, the conductor layer 41 and the conductor layer 44, the conductor layer 50 and the conductor layer 52, and the conductor layer 51 and the conductor layer 53). In such a configuration, it is possible to easily adjust a position of the auxiliary ground layer. That is, when the number of conductor layers is changed, the position can be adjusted. Thus, it is possible to easily adjust a distance between a part in which the main line 6 does not overlap the first sub line 7 and the second sub line 8 and the auxiliary ground layer.

In the laminated coupler 1 according to the present embodiment, the auxiliary ground layer (the conductor layer 39 and the conductor layer 42, the conductor layer 40 and the conductor layer 43, the conductor layer 41 and the conductor layer 44, the conductor layer 50 and the conductor layer 52, and the conductor layer 51 and the conductor layer 53) is electrically connected to the first ground layer (the conductor layer 38) or the second ground layer (the conductor layer 54) by the through-hole conductors (H11, H12, H13, H14, and H15). In such a configuration, it is possible to reliably electrically connect the auxiliary ground layer to the first ground layer or the second ground layer.

In the laminated coupler 1 according to the present embodiment, the first sub line 7 is formed by the conductor layer 45 and the conductor layer 47. The second sub line 8 is formed by the conductor layer 46 and the conductor layer 49. The conductor layer 45 and the conductor layer 47, and the conductor layer 46 and the conductor layer 49 are disposed at positions with the conductor layer 47 constituting the main line 6 therebetween in the lamination direction, and overlap the conductor layer 47 in the lamination direction. In such a configuration, it is possible to increase a coupling value of the main line 6 with respect to the first sub line 7 and the second sub line 8.

Second Embodiment

Figure 9:
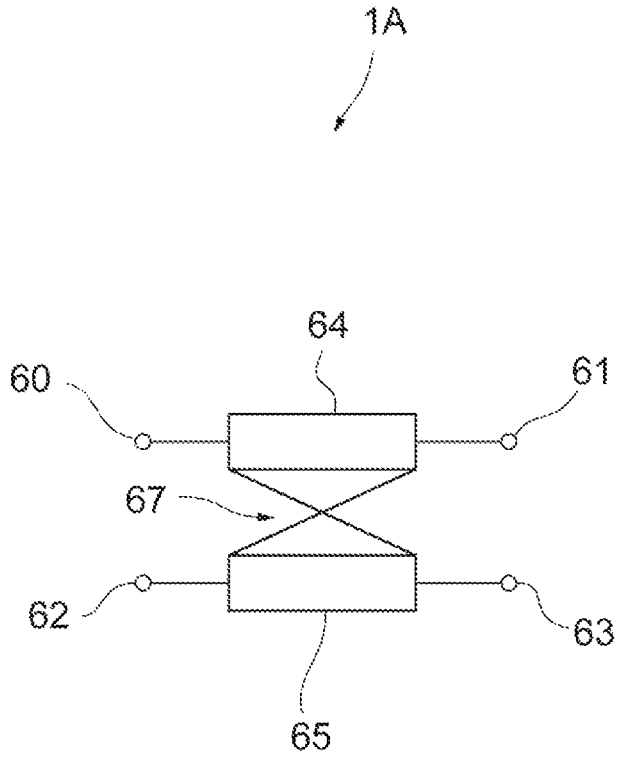
FIG. 9 is a diagram showing an equivalent circuit of a laminated coupler according to a second embodiment.

Next, a second embodiment will be described. As shown in FIG. 9, a laminated coupler 1A includes an input port (input terminal) 60, an output port (output terminal) 61, a coupling port 62, and a termination port 63. The laminated coupler 1A includes a main line 64 connected between the input port 60 and the output port 61 and a sub line 65 that is electromagnetically coupled to the main line 64. A part in which the main line 64 and the sub line 65 are coupled to each other is defined as a coupling part 67.

Figure 10:
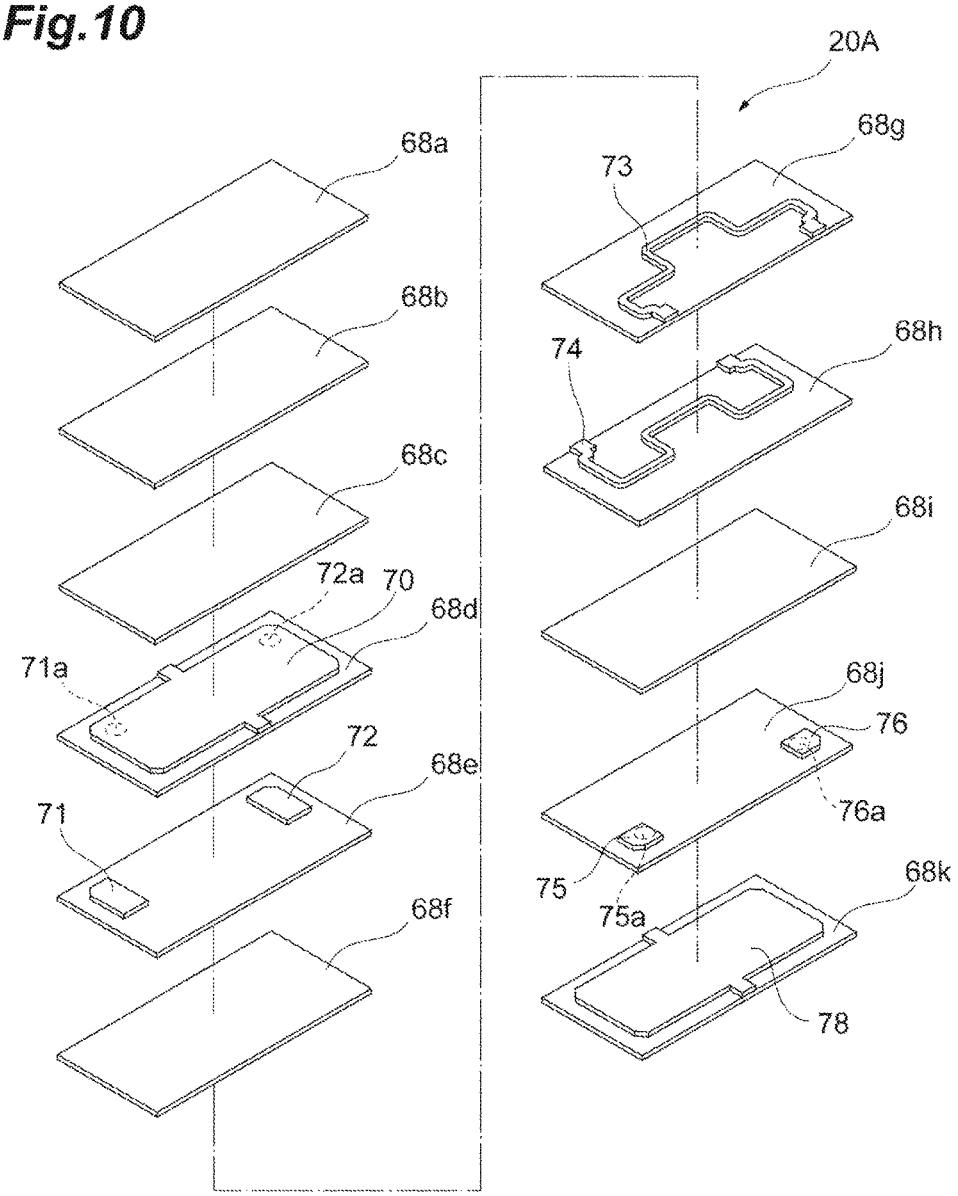
FIG. 10 is an exploded perspective view of an element body.

Next, a structure of the laminated coupler 1A will be described. The laminated coupler 1A includes an element body 20A, the first terminal electrode 21 (refer to FIG. 2), the second terminal electrode 22, the third terminal electrode 23, the fourth terminal electrode 24, the fifth terminal electrode 25, and the sixth terminal electrode 26. As shown in FIG. 10, the element body 20A is formed by laminating a plurality of insulator layers 68 (68*a* to 68*k*).

In the present embodiment, the first terminal electrode 21 constitutes the input port 60. The second terminal electrode 22 constitutes a ground. The third terminal electrode 23 constitutes the output port 61. The fourth terminal electrode 24 constitutes the coupling port 62. The fifth terminal electrode 25 constitutes a ground. The sixth terminal electrode 26 constitutes the termination port 63.

As shown in FIG. 10, a conductor layer 73 is formed on the insulator layer 68*g*. The conductor layer 73 constitutes the main line 64. One end of the conductor layer 73 is electrically connected to the first terminal electrode 21 (the input port 60). The other end of the conductor layer 73 is electrically connected to the third terminal electrode 23 (the output port 61).

A conductor layer 74 is formed on the insulator layer 68*h*. The conductor layer 74 constitutes the sub line 65. One end of the conductor layer 74 is electrically connected to the fourth terminal electrode 24 (the coupling port 62). The other end of the conductor layer 74 is electrically connected to the sixth terminal electrode 26 (the termination port 63). The conductor layer 73 and the conductor layer 74 are disposed at positions at which parts thereof overlap in the lamination direction. A part in which the conductor layer 73 and the conductor layer 74 overlap constitutes the coupling part 67.

A conductor layer 70 is formed on the insulator layer 68*d*. A conductor layer 78 is formed on the insulator layer 68*k*. The conductor layer 70 and the conductor layer 78 are disposed at positions with the conductor layer 73 and the conductor layer 74 therebetween in the lamination direction. That is, the conductor layer 70 and the conductor layer 78 are disposed at positions with the main line 64 and the sub line 65 therebetween in the lamination direction. The conductor layer 70 and the conductor layer 78 are electrically connected to the second terminal electrode 22 and the fifth terminal electrode 25. The conductor layer 38 and the conductor layer 54 constitute ground layers (the first ground layer and the second ground layer).

Figure 13:
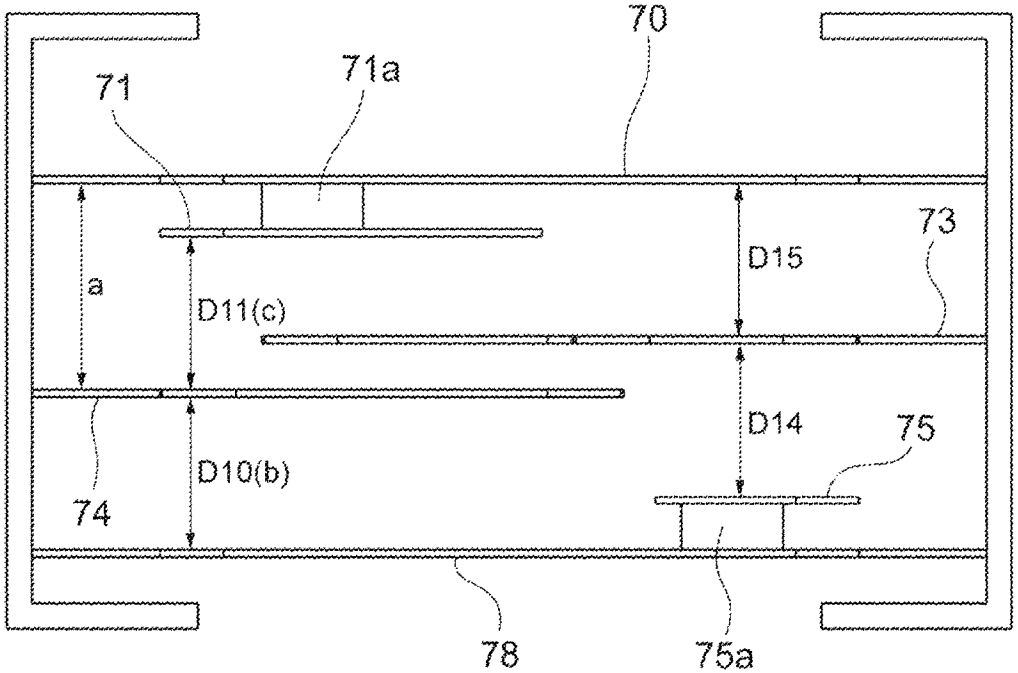
FIG. 13 is a diagram of a configuration in an element body viewed from the side of one end surface.

As shown in FIG. 13, a distance D15 (a distance D17 in FIG. 14) between the conductor layer 73 and the conductor layer 70 (the first ground layer) and a distance D10 (a distance D12 in FIG. 14) between the conductor layer 74 and the conductor layer 78 (the second ground layer) are the same (D15=D10). Accordingly, the conductor layer 73 and the conductor layer 70, and the conductor layer 74 and the conductor layer 78 are equivalent in a part (coupling part) in which the conductor layer 73 and the conductor layer 74 overlap in the lamination direction.

Figure 11:
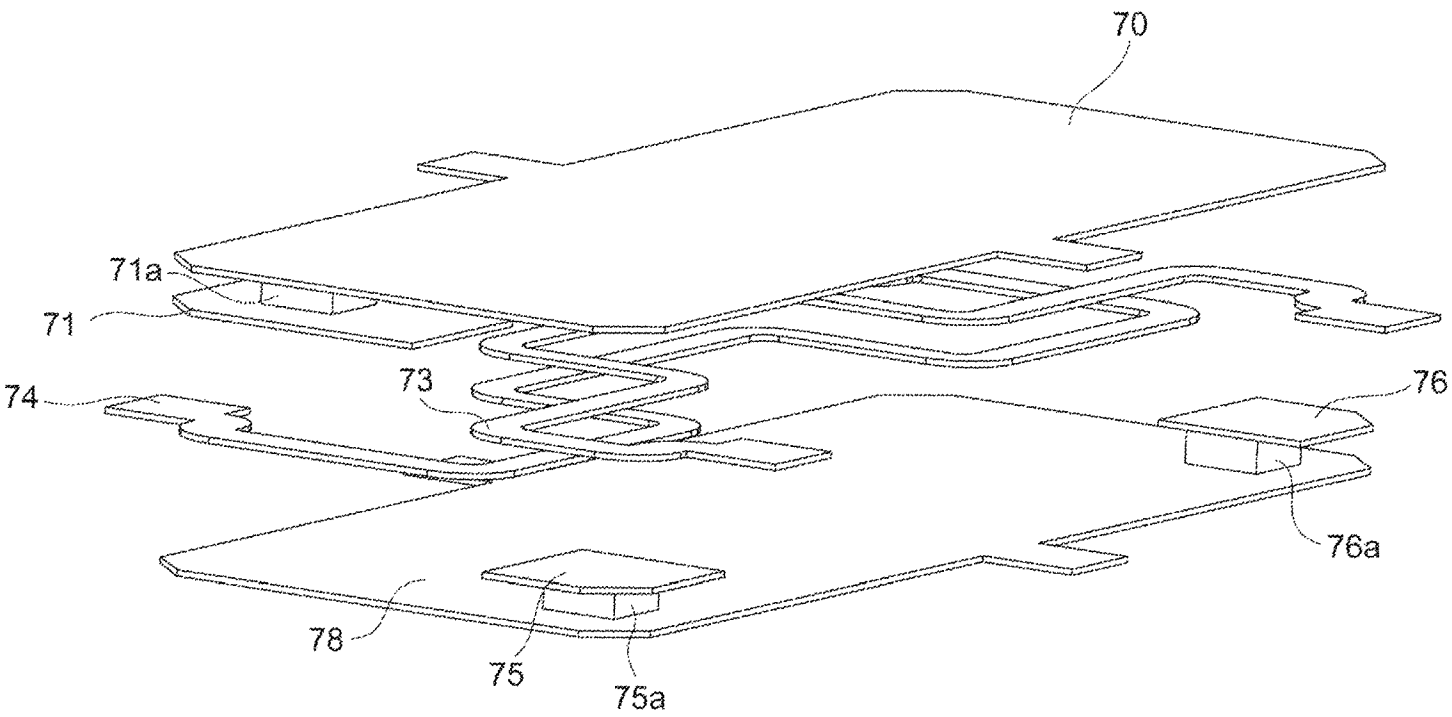
FIG. 11 is a perspective view showing a configuration in an element body.
Figure 12:
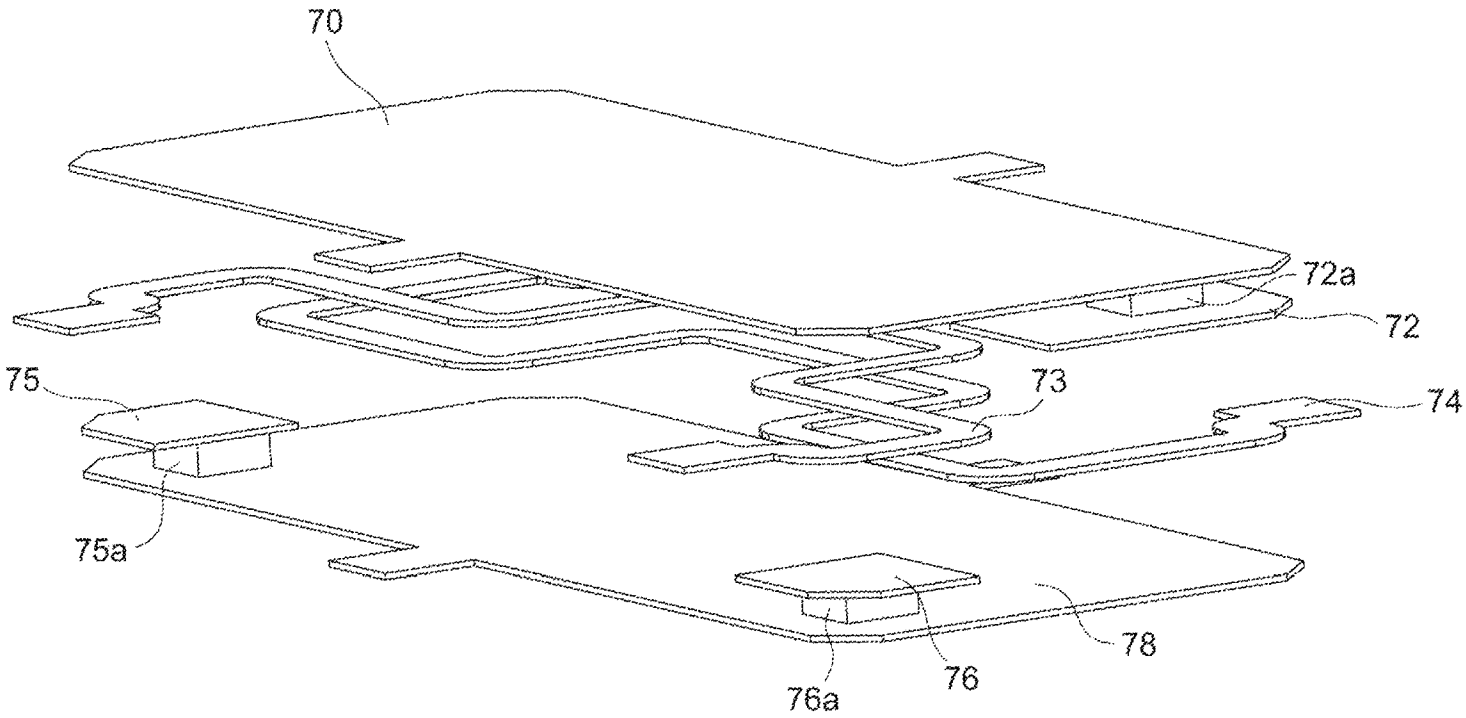
FIG. 12 is a perspective view showing a configuration in an element body.

As shown in FIG. 10, a conductor layer 71 and a conductor layer 72 are formed on the insulator layer 68*e*. As shown in FIG. 11, the conductor layer 71 is electrically connected to the conductor layer 70 by a through-hole conductor 71*a*. As shown in FIG. 12, the conductor layer 72 is electrically connected to the conductor layer 70 by a through-hole conductor 72*a*. The conductor layer 71 and the conductor layer 72 are electrically connected to a ground.

The conductor layer 71 and the conductor layer 72 are disposed at positions at which they overlap the conductor layer 74 in the lamination direction. Specifically, the conductor layer 71 and the conductor layer 72 are disposed in a part in which the conductor layer 74 does not overlap the conductor layer 73 in the lamination direction and at a position at which overlapping occurs in the lamination direction. The conductor layer 71 and the conductor layer 72 face the conductor layer 74 with the insulator layers 68*e* to 68*g* therebetween.

As shown in FIG. 10, a conductor layer 75 and a conductor layer 76 are formed on the insulator layer 68*j*. As shown in FIG. 11, the conductor layer 75 is electrically connected to the conductor layer 78 by a through-hole conductor 75*a*. As shown in FIG. 12, the conductor layer 76 is electrically connected to the conductor layer 78 by a through-hole conductor 76*a*. The conductor layer 75 and the conductor layer 76 are electrically connected to a ground.

The conductor layer 75 and the conductor layer 76 are disposed at positions at which they overlap the conductor layer 73 in the lamination direction. Specifically, the conductor layer 75 and the conductor layer 76 are disposed in a part in which the conductor layer 73 does not overlap the conductor layer 74 in the lamination direction and at a position at which overlapping occurs in the lamination direction. The conductor layer 75 and the conductor layer 76 face the conductor layer 73 with the insulator layers 68g to 68i therebetween.

The conductor layer 71 and the conductor layer 72, and the conductor layer 75 and the conductor layer 76 constitute auxiliary ground layers. The auxiliary ground layer is a part in which the main line 64 and the sub line 65 do not overlap in the lamination direction and is disposed to face the non-overlapping part in which a distance from the first ground layer (the conductor layer 70) and a distance from the second ground layer (the conductor layer 78) are different in the lamination direction. In the laminated coupler 1A, when a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of $a>c\geq b$ is satisfied. Specifically, for example, in an example shown in FIG. 13, a distance between the conductor layer 74 and the conductor layer 70 corresponds to the first distance a, a distance between the conductor layer 74 and the conductor layer 78 corresponds to the second distance b (D10), and a distance between the conductor layer 74 and the conductor layer 71 corresponds to the third distance c (D11). In the present embodiment, the auxiliary ground layer is provided at a position (c=b) at which the second distance b and the third distance c are the same.

Figure 14:
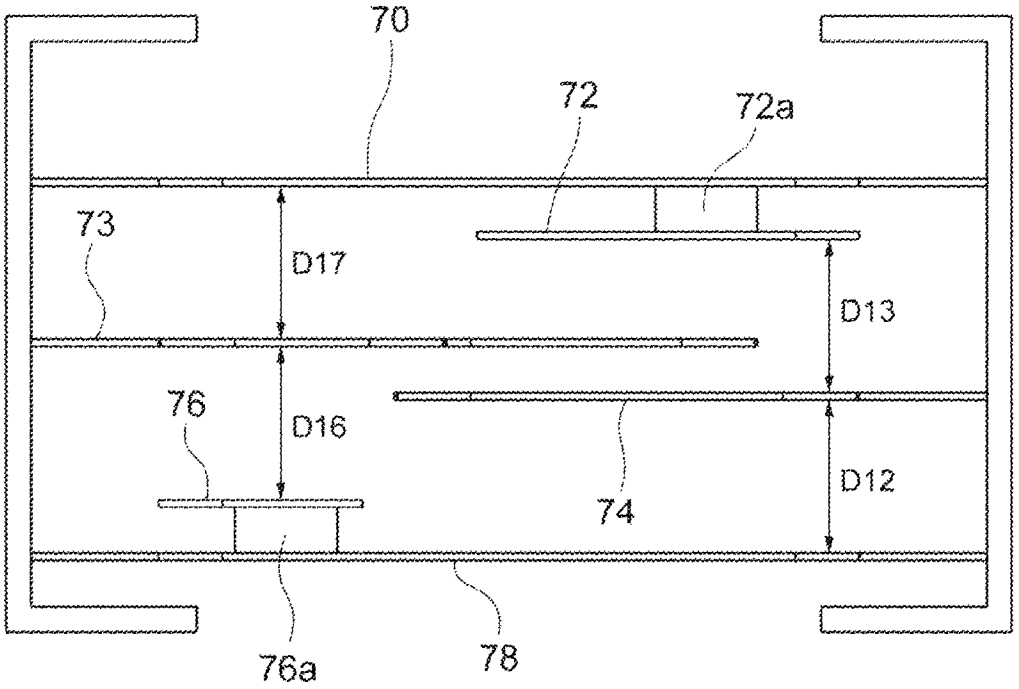
FIG. 14 is a diagram of a configuration in an element body viewed from the side of the other end surface.

In the present embodiment, a distance (the first distance a) between a part of the conductor layer 74 that does not overlap the conductor layer 73 and the conductor layer 70 and a distance (the second distance b) between the non-overlapping part and the conductor layer 78 are different. Therefore, the conductor layer 71 and the conductor layer 72 are disposed in the part of the conductor layer 74 that does not overlap the conductor layer 73. Thus, as shown in FIG. 13, a distance D10 (the second distance b) between a part in which the conductor layer 74 does not overlap the conductor layer 73 and the conductor layer 78 and a distance D11 (the third distance c) between the part in which the conductor layer 74 does not overlap the conductor layer 73 and the conductor layer 71 are the same (D10=D11). In addition, as shown in FIG. 14, a distance D12 (the second distance b) between the part in which the conductor layer 74 does not overlap the conductor layer 73 and the conductor layer 78 and a distance D13 (the third distance c) between the a part in which the conductor layer 74 does not overlap the conductor layer 73 and the conductor layer 72 are the same (D12=D13). That is, the conductor layer 71 and the conductor layer 72 are disposed at positions separated from the conductor layer 70 toward the conductor layer 74 by a distance obtained by subtracting a distance between the non-overlapping part and the conductor layer 78 from a distance between the part of the conductor layer 74 that does not overlap the conductor layer 73 and the conductor layer 70.

In the present embodiment, a distance (the second distance b) between a part of the conductor layer 73 that does not overlap the conductor layer 74 and the conductor layer 70 and a distance (the first distance a) between the non-overlapping part and the conductor layer 78 are different. Therefore, the conductor layer 75 and the conductor layer 76 are disposed at the part of the conductor layer 73 that does not overlap the conductor layer 74. Thus, as shown in FIG. 13, a distance D14 (the third distance c) between a part in which the conductor layer 73 does not overlap the conductor layer 74 and the conductor layer 75 and a distance D15 (the second distance b) between a part in which the conductor layer 73 does not overlap the conductor layer 74 and the conductor layer 70 are the same (D14=D15). In addition, as shown in FIG. 14, a distance D16 (the third distance c) between a part in which the conductor layer 73 does not overlap the conductor layer 74 and the conductor layer 76 and a distance D17 (the second distance b) between a part in which the conductor layer 73 does not overlap the conductor layer 74 and the conductor layer 70 are the same (D16=D17). That is, the conductor layer 75 and the conductor layer 76 are disposed at positions separated from the conductor layer 78 toward the conductor layer 73 by a distance obtained by subtracting a distance between the part and the conductor layer 70 from a distance between the part of the conductor layer 73 that does not overlap the conductor layer 74 and the conductor layer 78.

As described above, in the laminated coupler 1A according to the present embodiment, the auxiliary ground layer (the conductor layer 71 and the conductor layer 72, the conductor layer 75 and the conductor layer 76) is provided in the element body 20A. The auxiliary ground layer is a part in which the main line 64 (the conductor layer 73) and the sub line 65 (the conductor layer 74) do not overlap in the lamination direction and is disposed to face the part in which a distance from the first ground layer (the conductor layer 70) and a distance from the second ground layer (the conductor layer 78) are different in the lamination direction. In the laminated coupler 1A, when a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of $a>c\geq b$ is satisfied. In such a configuration, due to the auxiliary ground layer, a difference in the distance between the third distance c in the part in which the main line and the sub line do not overlap and the second distance b can be reduced. Thus, in the laminated coupler 1A, it is possible for occurrence of deviation in the impedance to be suppressed in the part in which the main line and the sub line do not overlap. Thus, in the laminated coupler 1A, it is possible to improve isolation characteristics.

While the embodiments of the present invention have been described above, the present invention is not necessarily limited to the above embodiments, and various modifications may be made without departing from the spirit and scope of the invention.

A form in which the laminated coupler 1 includes the phase adjustment circuit 9 has been described in the first embodiment as an example. However, no phase adjustment circuit may be included.

A form in which the auxiliary ground layer is provided at a position at which the second distance b and the third distance c are the same has been described in the above embodiment as an example. However, in the laminated coupler, when a longer distance is set as a first distance a and a shorter distance is set as a second distance b between a distance between a part in which the main line and the sub line do not overlap and the first ground layer and a distance between the non-overlapping part and the second ground layer, and a third distance between the non-overlapping part and the auxiliary ground layer is set as c, the relationship of $a>c\geq b$ may be satisfied. That is, the third distance c may be equal to or greater than the second distance b.

A form in which the terminal electrodes 21 to 23 are disposed on the side surface 20*e* and the main surfaces 20*c* and 20*d* and the terminal electrodes 24 to 26 are disposed on the side surface 20*f* and the main surfaces 20*c* and 20*d* has been described in the embodiment as an example. However, forms (disposition forms) of the terminal electrodes 21 to 26 are not limited thereto.

What is claimed is:

1. A directional coupler comprising:

an element body formed by laminating a plurality of insulator layers; and an input terminal and an output terminal that are disposed on an outer surface of the element body, wherein, in the element body, a main line connected between the input terminal and the output terminal, a sub line of which at least a part overlaps the main line in a direction in which the plurality of insulator layers are laminated and which is electromagnetically coupled to the main line, a first ground layer and a second ground layer that are disposed at positions with the main line and the sub line therebetween in the lamination direction, and an auxiliary ground layer that is electrically connected to the first ground layer or the second ground layer, are provided, wherein the auxiliary ground layer is a part in which the main line and the sub line do not overlap in the lamination direction and is disposed to face the non-overlapping part in which a distance from the first ground layer and a distance from the second ground layer are different in the lamination direction, and wherein, when a longer distance is set as a first distance a and a shorter distance is set as a second distance b between a distance between the non-overlapping part and the first ground layer and a distance between the non-overlapping part and the second ground layer, and a third distance between the non-overlapping part and the auxiliary ground layer is set as c, the relationship of $a>c\geq b$ is satisfied.

2. The directional coupler according to claim 1, wherein the auxiliary ground layer is provided at a position at which the second distance b and the third distance c are the same.

3. The directional coupler according to claim 1, wherein the plurality of auxiliary ground layers are provided in the lamination direction.

4. The directional coupler according to claim 1, wherein the auxiliary ground layer is electrically connected to the first ground layer or the second ground layer by a through-hole conductor.

5. The directional coupler according to claim 1, wherein the sub line is formed by a first sub line and a second sub line that are electrically connected to each other, and wherein the first sub line and the second sub line are disposed at positions with the main line therebetween in the lamination direction.

* * * * *